US007568341B2

(12) United States Patent
Borg et al.

(10) Patent No.: US 7,568,341 B2
(45) Date of Patent: Aug. 4, 2009

(54) PYROTECHNIC ACTUATOR WITH CONTROLLABLE FORCE AND OPTIMISED GEOMETRY

(75) Inventors: Evrard Borg, Martignas sur Jalle (FR); Eric Laspesa, Saint Medard en Jalles (FR); Jean-Paul Nadeau, Ollioules (FR)

(73) Assignee: SNPE Materiaux Energetiques, Paris (FR)

( * ) Notice: Subject to any disclaimer, the term of this patent is extended or adjusted under 35 U.S.C. 154(b) by 120 days.

(21) Appl. No.: 11/664,642

(22) PCT Filed: Oct. 4, 2005

(86) PCT No.: PCT/FR2005/002454

§ 371 (c)(1),
(2), (4) Date: May 31, 2007

(87) PCT Pub. No.: WO2006/040439

PCT Pub. Date: Apr. 20, 2006

(65) Prior Publication Data

US 2008/0047269 A1 Feb. 28, 2008

(30) Foreign Application Priority Data

Oct. 7, 2004 (FR) ..... 04 10591

(51) Int. Cl.
*F01B 29/08* (2006.01)
*F02N 13/00* (2006.01)

(52) U.S. Cl. ..... 60/635; 60/632; 60/637

(58) Field of Classification Search ..... 60/632, 60/633, 634, 635, 636, 637, 638; 102/530, 102/531; 251/89.5, 208, 352
See application file for complete search history.

(56) References Cited

U.S. PATENT DOCUMENTS

| | | | | |
|---|---|---|---|---|
| 5,303,631 | A | 4/1994 | Frehaut et al. | |
| 6,796,627 | B2 * | 9/2004 | Kimura et al. | 347/7 |

FOREIGN PATENT DOCUMENTS

| | | |
|---|---|---|
| DE | 3817042 | 12/1988 |
| EP | 0550321 | 7/1993 |
| EP | 1162333 | 12/2001 |
| EP | 1418121 | 5/2004 |
| EP | 1418121 A1 * | 5/2004 |
| FR | 2824875 | 11/2002 |

* cited by examiner

*Primary Examiner*—Thomas E Denion
*Assistant Examiner*—Christopher Jetton
(74) *Attorney, Agent, or Firm*—Hamre, Schumann, Mueller & Larson, P.C.

(57) ABSTRACT

The technical field of the invention is that of pyrotechnic actuators including a piston and having the essential function of exerting thrust to move an object by causing the piston to emerge. The invention relates more particularly to a pyrotechnic gas generator (2), a combustion chamber (3), a piston (10) capable of moving in a slide chamber (4) under the effect of said gas, the two chambers (3, 4) being in communication with each other. The main characteristic of this actuator is that it comprises a shutter device (5) implemented after said actuator (1) has been triggered to interrupt the communication between said chambers (3, 4), said shutter device (5) being included in the slide chamber (4).

10 Claims, 2 Drawing Sheets

PYROTECHNIC ACTUATOR WITH CONTROLLABLE FORCE AND OPTIMISED GEOMETRY

The technical field of the invention is that of pyrotechnic actuators including a piston and having the essential function of exerting thrust to move an object by causing the piston to emerge. Pyrotechnic actuators of the invention are particularly adapted for use in safety systems implemented in motor vehicles and serving, for example, to damp the movement of certain parts that are put into movement in the event of a mechanical impact between the motor vehicle and an external element, such as for example a safety belt, the front shield of the vehicle, a steering column, or the hood of the vehicle in the event of a head-on collision between the vehicle and a pedestrian.

Pyrotechnic actuators that make use of a piston are already the subject of several patent applications.

Mention can be made of patent EP 0 550 321 which describes a pyrotechnic actuator of damped stroke capable of being used in any type of energy absorber system. That actuator comprises a pyrotechnic gas generator, a piston, a chamber for combustion of pyrotechnic material, and a backpressure chamber together with an intermediate chamber lying in said combustion chamber and one end of the piston. A channel connects the intermediate chamber to the backpressure chamber. The gas emitted by the generator pressurizes the intermediate chamber to oppose movement of the piston, and thus damp its stroke, some of said gas being conveyed via the channel to the backpressure chamber.

French patent application FR 2 824 875 relates to a pyrotechnic actuator possessing a body, a piston, and a washer retaining said piston in said body. Depending on the initial position of the piston in the body, the actuator makes it possible either to exert thrust on an article by causing said piston to emerge from said body, or else to release a mechanical part by causing the piston to be retracted into said body.

The pyrotechnic actuators described in those two patents present nominal operation that is characterized by the piston moving through a constant amplitude, and thus generating a single effect on the parts or articles that are to interact with said actuators. The pyrotechnic actuators of the invention make use of a mechanical device for regulating pressure in the slide chamber of the piston thus making it possible to control the thrust force or the amplitude of the movement of said piston. In this way, pyrotechnic actuators of the invention present a variable thrust effect or even an adjustable stroke effect, and they can therefore be adapted to a plurality of configurations requiring the piston to move to a greater or lesser extent.

The present invention relates to a pyrotechnic actuator comprising a pyrotechnic gas generator, a combustion chamber, a piston capable of moving in a slide chamber under the effect of said gas, the two chambers being in communication with each other. The main characteristic of the actuator of the invention is that it comprises a shutter device implemented after said actuator has been triggered to interrupt the communication between said chambers, said shutter device being included in the slide chamber. In this way, the shutter device is housed in an already-existing chamber, thus making it possible to avoid any need to design a third chamber. As a result, actuators of the invention are compact and the machining they require is thereby simplified.

Advantageously, the shutter device is independent and can be triggered from a control center. Decoupling the triggering of the shutter device from the triggering of the actuator contributes to increasing the flexibility in use of said actuator and makes it easy to program the sequence of the two ignitions.

Preferably, both chambers are cylindrical in shape having their axes of symmetry mutually parallel, said chambers being interconnected by a connection channel of axis that is perpendicular to the axes of said chambers.

These characteristics confer an H-shape configuration on the actuator, thereby making it as compact as possible.

Advantageously, the pyrotechnic gas generator is included in the combustion chamber and comprises an ignitor and a pyrotechnic charge.

Preferably, the shutter device comprises a hollow cylindrical body fastened in the slide chamber, a motor, and a shutter, said body possession connection means, which, in combination with the connection channel, serve to ensure communication between the combustion chamber and the space of the slide chamber in which the piston is situated.

Advantageously, the connection means are constituted by at least one lateral bore situated in the hollow cylindrical body in continuity with the connection channel, and by a passage formed in one of the ends of said body, said passage providing communication between the inside of said body and the space of the slide chamber in which the piston is situated.

The lateral bore provides communication between the connection channel and the inside of the hollow cylindrical body.

Preferably, the hollow cylindrical body has a circular peripheral groove with a plurality of bores made in the bottom thereof, said groove being defined in part by the inside wall of the slide chamber, and the connection channel which opens out into said groove.

Advantageously, the bores are distributed regularly around said hollow body.

Preferably, the hollow cylindrical body comes into abutment against an internal shoulder of the slide chamber.

Advantageously, the motor is a pyrotechnic gas generator.

Preferably, said motor is constituted by an electropyrotechnic ignitor, possibly reinforced by a charge of gas-generator powder.

Preferably, the shutter is housed in the hollow cylindrical body and said shutter possesses an enlarged head suitable for sliding in sealed manner in said body, said head being extended by a cylindrical portion of smaller section terminating in a cylindrical portion of a larger section presenting a flat. More precisely, the outside surface of said enlarged head is in contact with the inside surface of said hollow body, sealing being provided by means of a circular gasket surrounding said head, said gasket being flattened against the inside surface of said hollow body.

Preferably, the enlarged head presents a frustoconical end, and the end of the body in which the passage is situated is terminated by a frustoconical recess suitable for receiving said frustoconical portion of the shutter.

Advantageously, the shutter is made of a deformable material such that after the motor has been triggered, the shutter moves in the hollow cylindrical body until the frustoconical portion of the enlarged head comes to fit accurately in the frustoconical recess of said body.

Pyrotechnic actuators of the invention present the advantage of being self-contained and of being compact because of their very simple design. They can thus easily be inserted in any type of device or article requiring the functions provided by said actuators. In addition, they present all of the advantages associated with using pyrotechnic charges, namely: reliability due to control over ignition; compactness due to the small size of the pyrotechnic charges; and a wide variety of possible effects due to the diversity of pyrotechnic compositions that can be used for such actuators. Finally, the use of pyrotechnic charges enables ignition between the actuator and the shutter device to be performed sequentially and under complete control.

There follows a detailed description of a preferred embodiment of the invention with reference to FIGS. 1 to 4.

Figure 1:
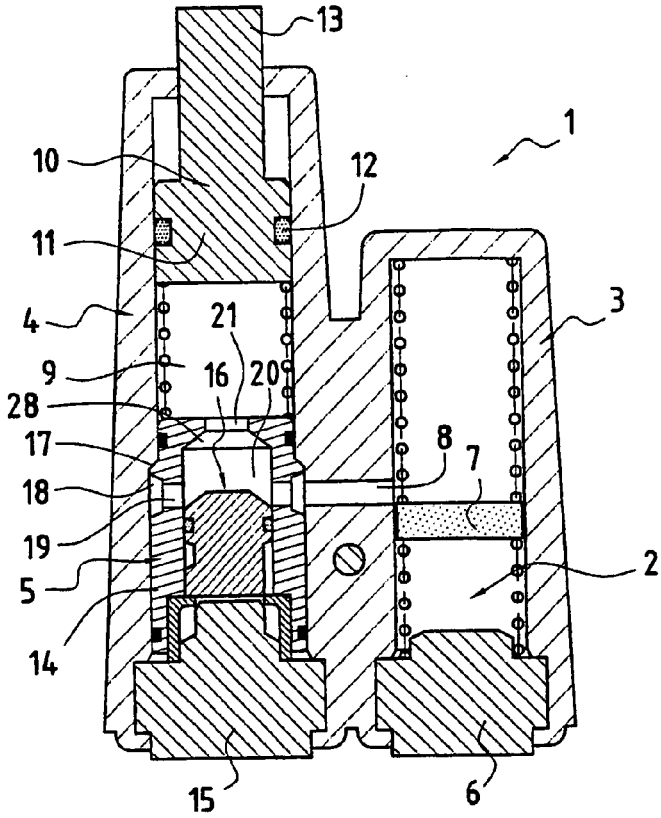
FIG. 1 is a longitudinal section view of an actuator of the invention at the beginning of operation.

With reference to FIG. 1, an actuator 1 of the invention comprises a gas generator 2, a combustion chamber 3, a slide chamber 4, and a shutter device 5.

The combustion chamber 3 is cylindrical in shape and contains the gas generator 2, said generator 2 comprising an ignitor 6 suitable for being triggered electrically, and a pyrotechnic charge 7 for generating gas. The ignitor 6 closes one of the ends of the combustion chamber 3, its other end being closed by design. The pyrotechnic charge 7 is in the form of a cylindrical block of propellant secured in the combustion chamber 3 and situated in the proximity of the ignitor 6. Over a fraction of its length, the combustion chamber 3 is beside the slide chamber 4, which itself is cylindrical in shape.

The two chambers 3, 4 are positioned relative to each other in such a manner that their axes of symmetry are parallel to each other and they are interconnected by cylindrical connection channel 8 whose axis of symmetry is perpendicular to the axes of the two chambers 3, 4. Thus, the actuator 1 of the invention is compact in shape due to its overall H-shape.

The slide chamber 4 has a first portion corresponding to the location where the shutter device 5 is situated, and a second portion corresponding to a cylindrical space 9 in which a piston 10 is placed, said space 9 being in continuity with the shutter device 5. The piston 10 presents an enlarged cylindrical body 11 suitable for sliding hermetically in said space 9 by means of a gasket 12 surrounding said enlarged body 11, said body 11 being extended by a rod 13 of smaller section. The shutter device 5 has a hollow cylindrical body 14 fastened in the slide chamber 4, a motor 15 in the form of an ignitor, and a shutter 16. The shutter device 5 comes into abutment against an internal shoulder 17 of the slide chamber 4. The hollow cylindrical body 14 has a circular peripheral groove 18 with a plurality of bores 19 formed in the bottom therein, which bores are distributed uniformly around said body 14, said groove 18 being defined in part by the inside wall of the slide chamber 4 and being positioned in said chamber so that the connection channel 8 opens out into said groove 18.

In this way, said bores 19, which can be thought of as radial channels, connect the connection channel 8 and thus the combustion chamber 3 to the internal portion 20 of the hollow cylindrical body 14 of the shutter device 5. Said hollow body 14 possesses an end that is defined in part by the ignitor 15, its other end presenting a passage 21 enabling the internal portion 20 of said hollow body 14 to be connected to the space 9 in which the piston 10 is placed. The slide chamber 4 has one end closed by the ignitor 15 while its other end is opened so as to allow the rod 13 of the piston 10 to emerge.

Figure 4:
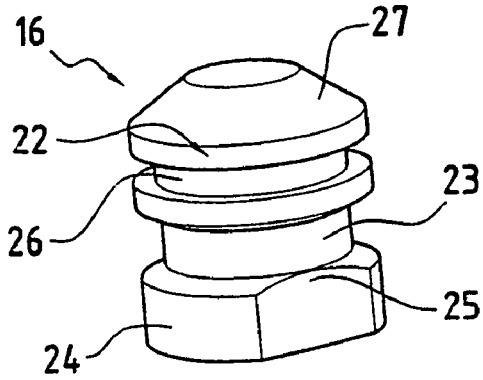
FIG. 4 is a perspective view of a shutter for an actuator of the invention.

With reference to FIG. 4, the shutter 16 is constituted by a cylindrical part possessing an enlarged head 22 extended by a cylindrical portion 23 of smaller section terminating in a cylindrical portion 24 of larger section presenting a flat 25. Said enlarged head 22 includes a circular peripheral groove 26 for receiving a sealing gasket, and it possesses a frustoconical end 27. The shutter 16 is made of a flexible material of the elastomer type.

The hollow cylindrical body 14 containing the passage 21 connecting the internal portion of said body 14 to the space 9 in which the piston 10 is placed has an end that is terminated by a frustoconical recess 28. Before operation of the actuator 1, the shutter 16 is placed in the hollow cylindrical body 14 in a position where it is as close as possible to the ignitor 15, while leaving free the bores 19 and the passage 21, thus ensuring communication can take place between the combustion chamber 3 and the space 9 of the slide chamber 4 in which the piston 10 is placed.

The actuator 1 of the invention operates in performing the following steps.

With reference to FIG. 1, the pyrotechnic gas generator 2 situated in the combustion chamber 3 is initiated in combustion by means of the ignitor 6 which is triggered by an electric signal.

Figure 2:
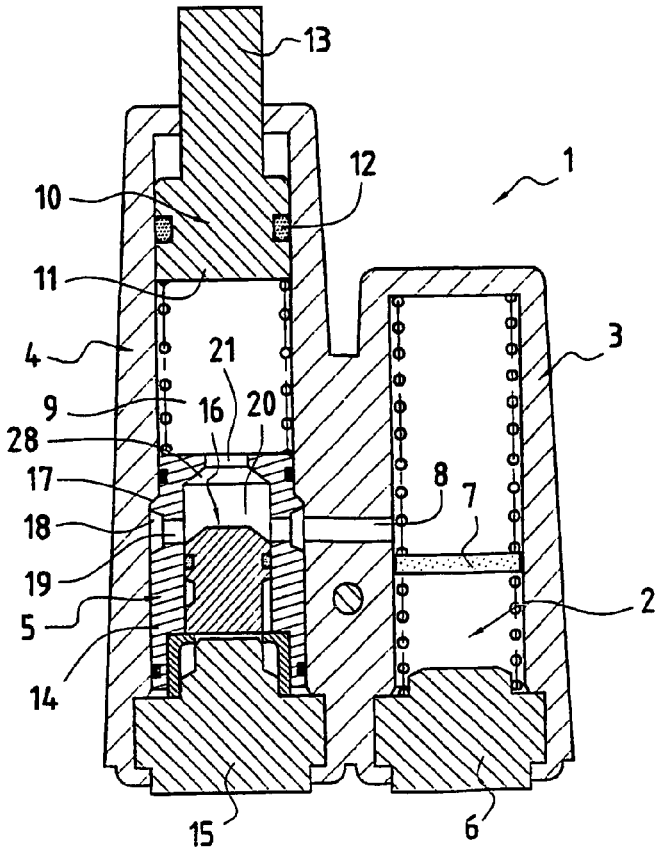
FIG. 2 is a longitudinal section view of the FIG. 1 actuator while in operation, the shutter device not yet being triggered.

With reference to FIG. 2, the gas produced by combustion of the pyrotechnic charge 7 invades the combustion chamber 3 and then the connection channel 8 and subsequently passes into the peripheral groove 18 of the hollow cylindrical body 14, and then through the internal portion 20 of said body 14, finally reaching the space 9 in which the piston 10 is placed. Pressurizing said space 9 causes the piston 10 to move with its rod 13 emerging progressively from the slide chamber 4.

Figure 3:
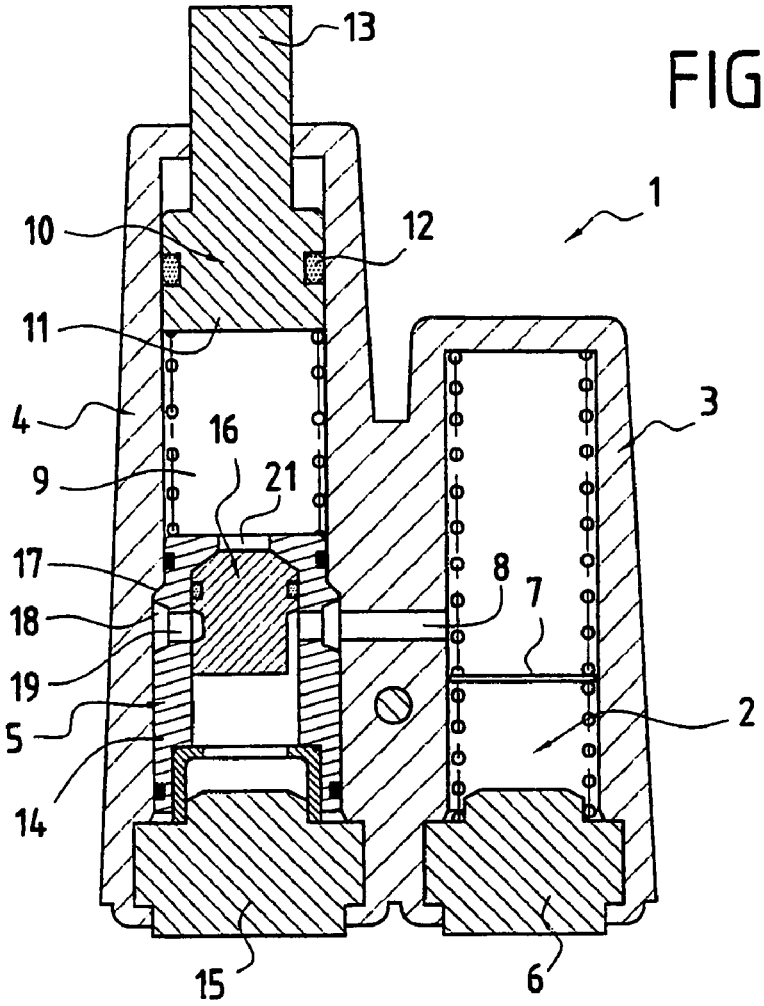
FIG. 3 is a longitudinal section view of the FIG. 1 actuator at the end of operation, after the shutter device has been triggered.

With reference to FIG. 3, the ignitor 15 of the shutter device 5 is ignited at a given instant, causing the shutter 16 to move in the hollow body 14 towards the space 9 in which the piston 10 is placed. The shutter 16 terminates its course when the frustoconical end 27 of its enlarged head 22 engages accurately in the frustoconical recess 28 of one of the ends of the hollow body 14, thereby shutting off the bores 19 and the passage 21. The gas coming from the combustion chamber 3 then invades the space of the hollow body 14 situated behind the shutter 16, said space having been generated by the displacement of said shutter 16.

The passage of said gas into said space is made possible by the flat 25 of the shutter 16 which leaves an opening. The pressure of said space contributes to holding the shutter 16 in its position closing the circuit interconnecting the two chambers 3 and 4.

The invention claimed is:

1. A pyrotechnic actuator comprising a pyrotechnic gas generator, a combustion chamber, a slide chamber, a piston capable of moving in the slide chamber under the effect of gas from said gas generator, the two chambers being in communication with each other via a connection channel, said actuator further including a shutter device which when implemented after said actuator has been triggered interrupts communication between said chambers, said shutter device being included in the slide chamber;

wherein both said chambers are cylindrical in shape, have axes of symmetry mutually parallel, and are interconnected by the connection channel having an axis that is perpendicular to the axes of said chambers, and wherein the shutter device comprises a hollow cylindrical body fastened in the slide chamber, a motor, and a shutter, said body possessing connection means, which, in combination with the connection channel, serve to ensure communication between the combustion chamber and a space of the slide chamber in which the piston is situated.

2. The actuator according to claim 1, wherein the shutter device is independent and can be triggered from a control center.

3. The actuator according to claim 1, wherein the pyrotechnic gas generator is included in the combustion chamber and in that said gas generator comprises an ignitor and a pyrotechnic charge.

4. The actuator according to claim 1, wherein the connection means are constituted by at least one lateral bore situated in the hollow cylindrical body in continuity with the connection channel, and by a passage formed in one of the ends of said body, said passage providing communication between the inside of said body and the space of the slide chamber in which the piston is situated.

5. The actuator according to claim 4, wherein the hollow cylindrical body has a circular peripheral groove with a plurality of lateral bores, said groove being defined in part by an inside wall of the slide chamber, and in that the connection channel opens out into said groove.

6. The actuator according to claim 1, wherein the hollow cylindrical body comes into abutment against an internal shoulder of the slide chamber.

7. The actuator according to claim 1, wherein the motor is a pyrotechnic gas generator.

8. The pyrotechnic actuator according to claim 4, wherein the shutter is housed in the hollow cylindrical body and in that the shutter possesses an enlarged head suitable for sliding in sealed manner in said body, said head being extended by a cylindrical portion of smaller section terminating in a cylindrical portion of a larger section which includes a flat.

9. The actuator according to claim 8, wherein the enlarged head includes a frustoconical end, and in said one of the ends of the body in which the passage is situated is terminated by a frustoconical recess suitable for receiving said frustoconical end of the shutter.

10. The actuator according to claim 9, wherein the shutter is made of a deformable material such that after the motor has been triggered, the shutter moves in the hollow cylindrical body until the frustoconical end of the enlarged head comes to fit accurately in the frustoconical recess of said body.

* * * * *